US008864127B2

(12) United States Patent
Uchino et al.

(10) Patent No.: US 8,864,127 B2
(45) Date of Patent: Oct. 21, 2014

(54) PAPER SUPPLY UNIT AND IMAGE FORMING APPARATUS

(75) Inventors: Yoshinori Uchino, Kanagawa (JP); Tohru Watanabe, Kanagawa (JP); Eiji Tachibana, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 13/412,968

(22) Filed: Mar. 6, 2012

(65) Prior Publication Data

US 2012/0228821 A1 Sep. 13, 2012

(30) Foreign Application Priority Data

Mar. 10, 2011 (JP) ..... 2011-052778

(51) Int. Cl.
*B65H 1/10* (2006.01)
*B65H 1/12* (2006.01)
*B65H 1/26* (2006.01)

(52) U.S. Cl.
CPC ..... *B65H 1/12* (2013.01); *B65H 2402/542* (2013.01); *B65H 2511/20* (2013.01); *B65H 1/266* (2013.01); *B65H 2515/30* (2013.01)
USPC ..... 271/160; 271/147; 271/162; 271/126; 271/127

(58) Field of Classification Search
USPC ..... 271/147, 160, 162, 126, 127, 157, 145
See application file for complete search history.

(56) References Cited

U.S. PATENT DOCUMENTS

| | | | | |
|---|---|---|---|---|
| 5,181,713 | A * | 1/1993 | Neugebauer | 271/160 |
| 5,232,215 | A * | 8/1993 | Hashimoto et al. | 271/160 |
| 5,890,711 | A * | 4/1999 | Kim | 271/127 |
| 6,149,147 | A * | 11/2000 | Hur et al. | 271/160 |
| 7,673,872 | B2 * | 3/2010 | Lee et al. | 271/160 |
| 7,681,878 | B2 * | 3/2010 | Youn | 271/160 |
| 8,333,375 | B2 * | 12/2012 | Nishikata et al. | 271/127 |
| 2004/0256789 | A1 * | 12/2004 | Hsu | 271/126 |
| 2005/0253327 | A1 * | 11/2005 | Soo | 271/157 |

FOREIGN PATENT DOCUMENTS

| | | | | |
|---|---|---|---|---|
| JP | 05092823 | A * | 4/1993 | B65H 1/12 |
| JP | 6-127710 | | 5/1994 | |

* cited by examiner

*Primary Examiner* — Prasad Gokhale
(74) *Attorney, Agent, or Firm* — Cooper & Dunham LLP

(57) ABSTRACT

A disclosed paper supply unit includes a paper supply cassette having a bottom plate for placing stacked recording media therein and a sending out part. When the paper supply cassette is loaded at a paper supply position, the sending out part faces the bottom plate, the bottom plate is lifted and the recording media come into contact with the sending out part. A support member is rotatably fitted to the paper supply cassette. An elastic member is fastened between the support member and the bottom plate. The support member has plural fastening parts for fastening the elastic member. The elastic force of the elastic member is changeable using the plural fastening parts.

9 Claims, 6 Drawing Sheets

PAPER SUPPLY UNIT AND IMAGE FORMING APPARATUS

BACKGROUND OF THE INVENTION

1. Field of the Invention

The present invention relates to a paper supply unit which supplies stacked sheet-like recording media, sheet by sheet, and an image forming apparatus including the paper supply unit.

2. Description of the Related Art

In an image forming apparatus such as a printer, a copier, a facsimile machine, or a multifunction peripheral (MFP) having functions of at least two thereof, a paper supply unit is provided which supplies sheets of paper as recording media stacked on a paper supply cassette or a paper supply tray, sheet by sheet. As such a kind of a paper supply unit, a paper supply unit of a roller paper supply type is known which sends out sheets of paper stacked on a paper supply tray to a conveyance path using a pickup roller.

In the paper supply unit of the roller paper supply type, it is necessary to press sheets of paper to the pickup roller with certain pressure, and the paper supply pressure is generated as a result of a bottom plate on which the sheets of paper are placed being pressed upward by a spring. At this time, the necessary paper supply pressure differs depending on each particular type of the paper. Generally speaking, the paper supply pressure is to be increased as the thickness of a sheet of paper becomes greater, and in the contrary, the paper supply pressure is to be decreased as the thickness of a sheet of paper becomes less. Then, when the paper supply pressure is too high with respect to proper one, supplying plural sheets of paper at a time occurs, and when the paper supply pressure is too low, a failure of supplying a sheet of paper occurs. The paper supply pressure of a normal image forming apparatus is designed to have a value corresponding to a thickness of plain paper that is commonly used.

However, there is a user who intends to use mainly thin paper or thick paper which thus needs the paper supply pressure outside the range of the paper supply pressure of the paper supply unit. When such a kind of paper is supplied, the normal paper supply pressure is to be changed to correspond to the kind of paper since supplying plural sheets of paper at a time or a failure of supplying a sheet of paper occurs when the normal paper supply pressure is used.

Japanese Laid-Open Patent Application No. 6-127710 (hereinafter, simply referred to as Patent Document 1) discloses a cassette paper supply unit in which it is possible to adjust the paper supply pressure. However, according to Patent Document 1, complicated work may be needed to change the paper supply pressure, and much time may be consumed therefor. That is, according to Patent Document 1, in a first embodiment, a support for a pressure spring that generates the paper supply pressure is removed, and then, the support for the pressure spring is fitted to another position. In this method, since the paper supply pressure changing work is carried out after the pressure spring is thus completely removed from the paper supply cassette, time may be consumed.

According to Patent Document 1, in a second embodiment, as a result of an operator rotating a pressure spring, the pressure spring is gradually embedded into a cylindrical depression provided below a bottom plate of a paper supply unit. In this method, the cylindrical depression has a spiral groove on an inner circumferential wall, and a spiral element of the pressure spring is gradually fitted into the spiral groove of the cylindrical depression as the pressure spring is rotated by the operator. Thus, the length of an upper part of the pressure spring projecting from the top end of the cylindrical depression can be adjusted merely by rotating the pressure spring to adjust the length of a lower part of the pressure spring embedded in the cylindrical depression. However, in this method, the operator needs to remove the bottom plate from a body of the paper supply unit in order to rotate the pressure spring that presses the bottom plate to apply the paper supply pressure to the paper placed on the bottom plate. Thus, in this method, removing the bottom plate, and then returning the same (after the adjustment of the paper supply pressure by rotating the pressure spring) may consume much time.

Further, in the paper supply unit according to Patent Document 1, in addition to the above-mentioned problems concerning the time consumed for the work, the pressure spring is in a state of always lifting the bottom plate toward a pickup roller. Therefore, it may be difficult to set sheets of paper in the paper supply cassette, and the number of sheets of paper that can be set in the paper supply cassette may be reduced.

SUMMARY OF THE INVENTION

According to an aspect of the present invention, there is a paper supply unit configured to include a paper supply cassette having a bottom plate for placing stacked recording media thereon, the bottom plate being able to be lifted at a downstream side part in a recording medium sending out direction; and a sending out part configured to be disposed above and facing the downstream part of the bottom plate when the paper supply cassette is loaded at a paper supply position. When the paper supply cassette is loaded at the paper supply position, the bottom plate is lifted so that the recording media come into contact with the sending out part. Further, a support member is rotatably fitted at a downstream side part in the recording medium sending out direction of the paper supply cassette. An elastic member is provided between the support member and the bottom plate to connect them, and elastic force of the elastic member is used to lift the bottom plate. The support member has plural fastening parts for fastening the elastic member, and the elastic force of the elastic member is changeable using the plural fastening parts.

According to another aspect of the present invention, there is a paper supply unit configured to include a paper supply cassette having a bottom plate for placing stacked recording media thereon, the bottom plate being able to be lifted at a downstream side part in a recording medium sending out direction; and a sending out part configured to be disposed above and facing the downstream part of the bottom plate when the paper supply cassette is loaded at a paper supply position. When the paper supply cassette is loaded at the paper supply position, the bottom plate is lifted to enter a state in which the recording media come into contact with the sending out part. Further, a support member is rotatably fitted at a downstream side part in the recording medium sending out direction of the paper supply cassette. An elastic member is provided between the support member and the bottom plate to connect them, and elastic force of the elastic member is used to lift the bottom plate. The bottom plate has plural fastening parts for fastening the elastic member, and the elastic force of the elastic member is changeable using the plural fastening parts.

Other objects, features and advantages of the present invention will become more apparent from the following detailed description when read in conjunction with the accompanying drawings.

DESCRIPTION OF THE EMBODIMENTS

Specific exemplary embodiments of the present invention, described below, have been devised in order to solve the above-mentioned problems in the related art, and an object of the embodiments of the present invention is to provide a paper supply unit and an image forming apparatus which have simple configurations and are inexpensive, and by which a change/adjustment of a paper supply pressure can be carried out by simple work.

According to an embodiment of the present invention, a support member is rotatably fitted at a downstream side part in a recording medium sending out direction of a paper supply cassette, and an elastic member is provided between the support member and a bottom plate of the paper supply cassette to connect them. For example, the support member has plural fastening positions for fastening the elastic member, and the elastic force of the elastic member is changeable using the plural fastening positions. Therefore, it is possible to change the paper supply pressure merely by changing the fastening position for fastening the elastic member.

Below, the specific exemplary embodiments of the present invention will be described with reference to the drawings.

Figure 1:
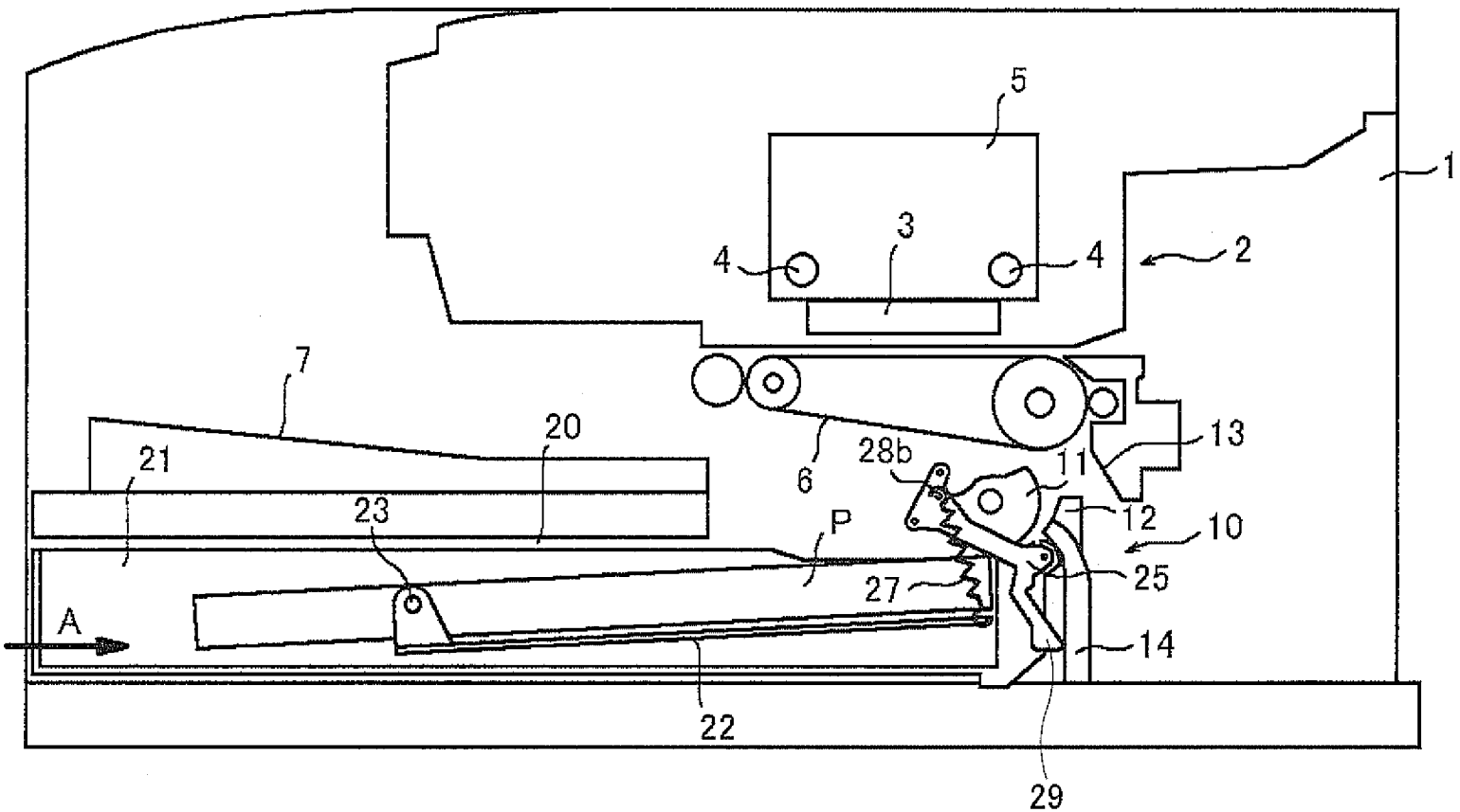
FIG. 1 is a general configuration diagram showing an image forming apparatus including a paper supply unit according to a first embodiment of the present invention.

FIG. 1 is a general configuration diagram showing the entirety of an image forming apparatus including a paper supply unit according to a first embodiment of the present invention.

The image forming apparatus shown in FIG. 1 is an inkjet printer. In the image forming apparatus, a recording part 2 (as an image forming part) for carrying out printing on a sheet of paper P as a recording medium is provided approximately at the center of an upper part of a printer body 1. Below the recording part 2, a paper supply part 10 (as a paper supply unit) for supplying the sheet of paper P is provided. The recording part 2 has an inkjet head 3, a carriage 5 and a conveyance belt 6. The inkjet head 3 includes four ink cartridges (not shown) containing inks of four colors, i.e., cyan (C), magenta (M), yellow (Y) and black (K), respectively, and plural nozzle rows. The inks are supplied from the respective ink cartridges. The ink cartridges and the inkjet head 3 are mounted on the carriage 5, and the carriage 5 moves in main scan directions guided by guide rods 4. The conveyance belt 6 conveys the sheet of paper P on which the printing is carried out. The paper supply part 10 has a paper supply cassette (described later) 20, and a paper supply roller 11 (having a semicircular shape) (as a sending out part) and a separation pad 12, by which the sheets of paper P stacked in the paper supply cassette 20 are sent out, sheet by sheet.

When the image forming apparatus of FIG. 1 carries out the printing on the sheet of paper P based on image data that is sent from a host apparatus (not shown), the sheet of paper P is sent out to the conveyance belt 6 by the paper supply roller 11 via a conveyance guide 13. As a result of the conveyance belt 6 being electrified by an electrification unit (not shown), the conveyance belt 6 attracts the sent out sheet of paper P electrostatically. The sheet of paper P on the conveyance belt 6 is conveyed in a sub-scan direction by the conveyance belt 6 each time when recording for one line is carried out on the sheet of paper P by the inkjet head 3 that is moved by the carriage 5 in the main scan directions. The recording on the sheet of paper P by the inkjet head 3 is carried out as a result of ink droplets being discharged onto the sheet of paper P by the inkjet head 3. These operations of recording for one line on the sheet of paper P and moving the sheet of paper P in the sub-scan direction are repeated, and thus, characters and/or images according to the image data are recorded on the sheet of paper P. The sheet of paper P for which the recording has been thus finished is ejected to a paper ejection part 7 provided above the paper supply part 10.

Figure 2:
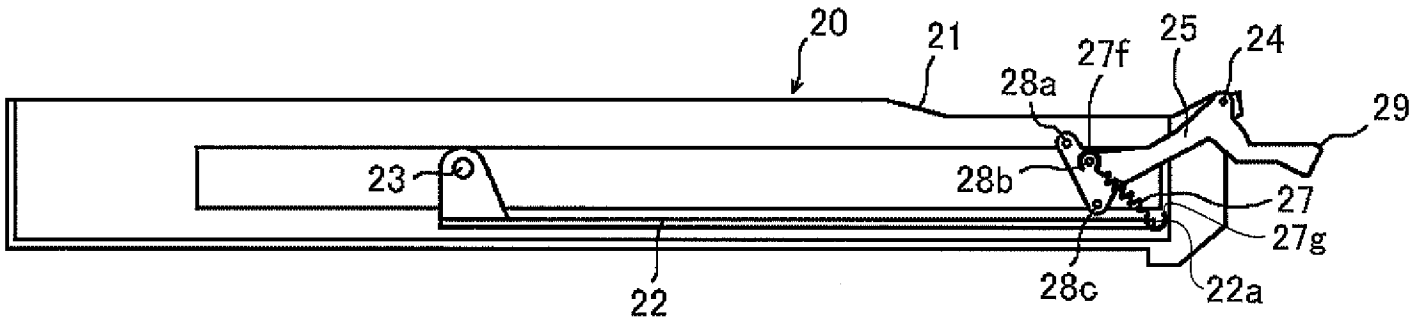
FIG. 2 illustrates a paper supply cassette of the paper supply unit.

FIG. 2 shows a cross-sectional view of the paper supply cassette 20 that will be removably loaded in the paper supply part 10.

Figure 3:
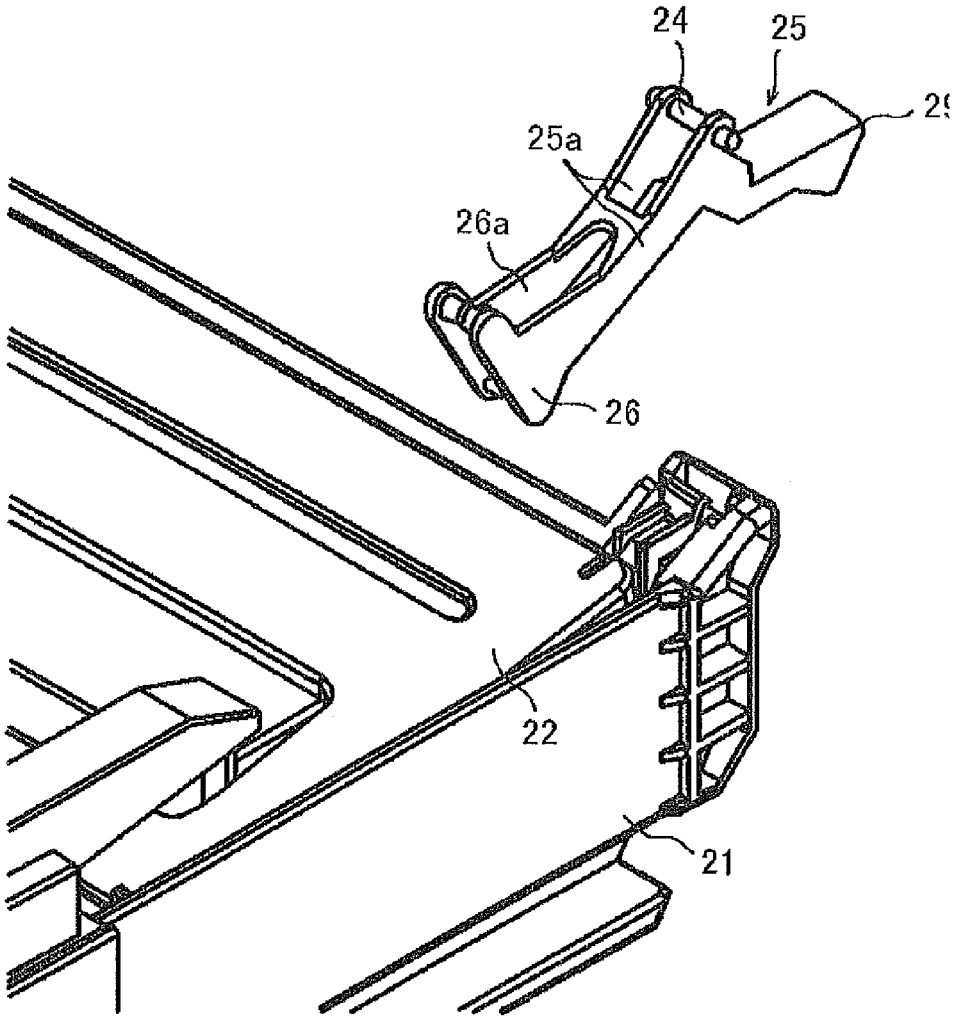
FIG. 3 is a partial exploded perspective view of the paper supply cassette.

In the paper supply cassette 20, a bottom plate 22 is fitted. One end of the bottom plate 22 is pivotally supported by a cassette body 21 via a pin 23. Therefore, the other end of the bottom plate 22, i.e., the downstream end in a paper sending out direction (i.e., the rightward direction in FIG. 2), is movable upward and downward while the bottom plate 22 is being rotated around the pin 23. The sheets of paper P are stacked and placed on the bottom plate 22. Further, an arm member 25 (as a support member or a support arm) is rotatably fitted to the cassette body 21 at the downstream end in the paper sending out direction via a supporting shaft 24. The arm member 25 has a T-part 26 (see FIG. 3) formed at one end. The T-part 26 is formed to have a side surface having a T shape. The T-part 26 has plural fastening parts (providing plural fastening positions) as fastening pins 28. A pressure spring 27 as an elastic member is fastened to any one of the plural fastening pins 28, and is also fastened to a fastening part 22*a* of the bottom plate 22. The pressure spring 27 may be a helical tension spring. A leg part 29 is formed at the other end of the arm member 25. The supporting shaft 24 is provided at a position somewhat approaching the leg part 29 from the center. Counterclockwise rotational force (torque) is applied around the supporting shaft 24 to the arm member 25 by the function of the pressure spring 27 in a state where the paper supply cassette 20 has been removed from the printer body 1, as shown in FIG. 2. However, in this state, the arm member 25 is kept in a position, in which the leg part 29 extends approximately horizontally, by a stopper (not shown) while the elastic force is applied to the arm member 25 by the pressure spring 27. It is noted that the position of the arm member 25 shown in FIG. 2 is referred to as a standby position. Then, when the paper supply cassette 20 is loaded in the printer body 1 as a result of being inserted in a direction of an arrow A shown in FIG. 1, the leg part 29 comes into contact with a curved plate 14 that is provided at a position to face an end surface of the paper supply cassette 20, which end surface is an end surface in the insertion direction. Then, the arm member 25 is rotated clockwise around the supporting shaft 24 by the leg part 29 sliding along a curved shape of the curved plate 14. As a result of the rotation of the arm member 25, the extending end of the bottom plate 22 is lifted via the pressure spring 27, and the suitable paper supply pressure is generated (between the sheets of paper P and the paper supply roller 11) as a result of the top surface of the sheets of paper P stacked on the bottom plate 22 being pressed against the paper supply roller 11. It is noted that the position of the arm member 25 shown in FIG. 1 is referred to as an elastic function position.

Figure 4:
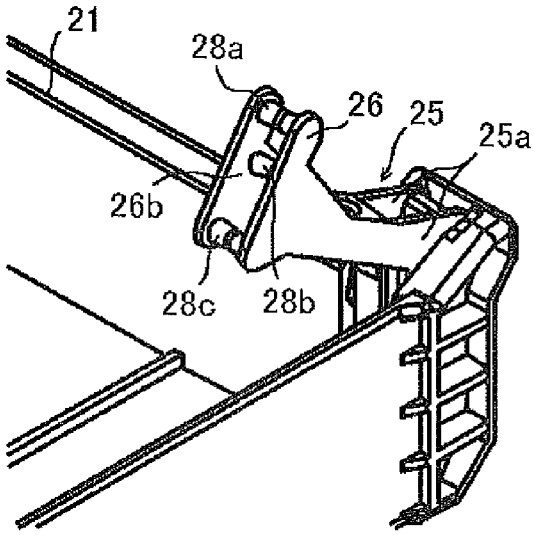
FIG. 4 is a partial perspective view of the paper supply cassette.

The arm member 25 configured as described above has a structure, as shown in FIGS. 3 and 4, in which two plate members 25*a* are combined while a suitable distance is provided therebetween. The fastening pins 28 are fitted between the two plate members 25*a*. According to the first embodiment of the present invention, the three fastening pins 28 are provided, and the three fastening pins 28, i.e., 28*a*, 28*b* and 28*c*, are provided at positions having different distances from the fastening part 22*a* of the bottom plate 22. Thereby, it is possible to adjust the paper supply pressure (the magnitude of pressure at which the sheets of paper P are pressed against the paper supply roller 11) by selecting any one of the fastening pins 28*a*, 28*b* and 28*c* on which a hook 27*f* (having a semicircular shape) formed on the pressure spring 27 will be hung. Further, another hook 27*g* also having a semicircular shape is formed on the other end of the pressure spring 27 which will be hung on the fastening part 22*a* of the bottom plate 22, as shown in FIG. 2. In this regard, the fastening part 22*a* of the bottom plate 22 may be a projection that projects from a corner or a part near the corner of the bottom plate 22, like a fastening part 22*a* according to a second embodiment described later using FIGS. 8 and 9.

Figure 6:
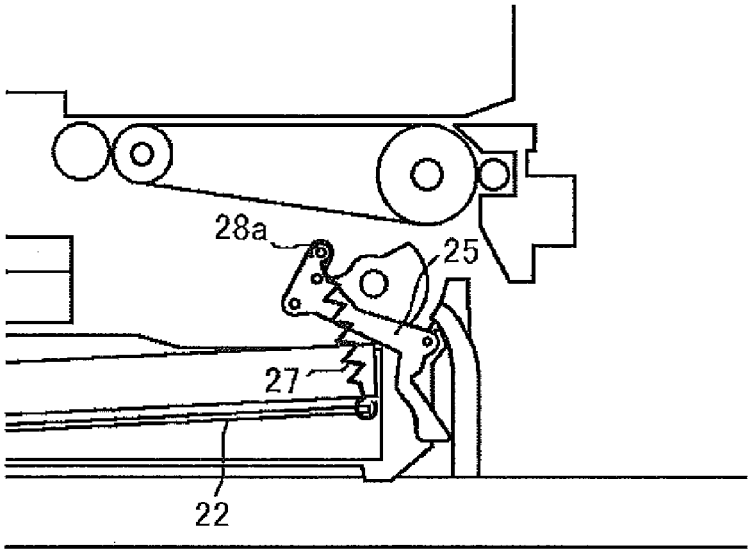
FIG. 6 illustrates a state where a paper supply pressure is increased.
Figure 7:
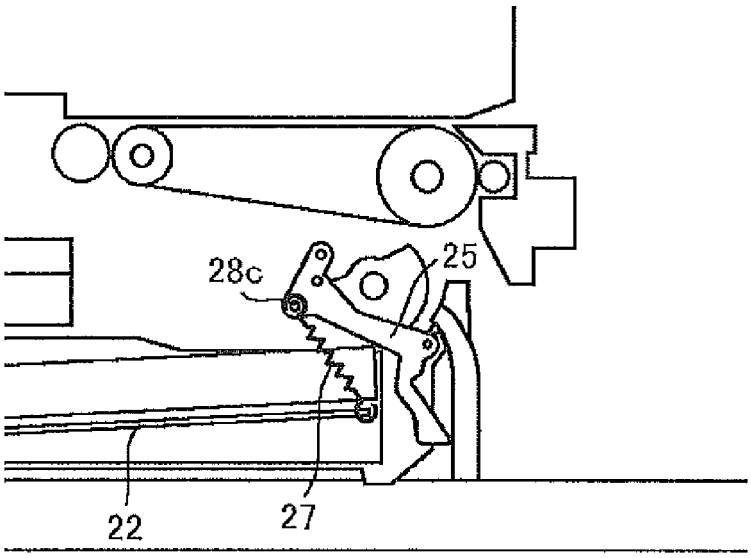
FIG. 7 illustrates a state where a paper supply pressure is decreased.

According to the first embodiment, the positions of the fastening pins 28*a*, 28*b* and 28*c* are previously determined to obtain the respective suitable paper supply pressures, as follows. In a case where the hook 27*f* of the pressure spring 27 is hung on the fastening pin 28*b* positioned at the center as shown in FIG. 1, the paper supply pressure is set at a pressure suitable for paper called plain paper. In a case where the hook 27*f* of the pressure spring 27 is hung on the right hand, farthest fastening pin 28*a* as shown in FIG. 6, the paper supply pressure is set at a pressure suitable for thick paper or cardboard. In a case where the hook 27*f* of the pressure spring 27 is hung on the left hand, nearest fastening pin 28*c* as shown in FIG. 7, the paper supply pressure is set at a pressure suitable for thin paper. In other words, the state of FIG. 6 provides the highest paper supply pressure, the state of FIG. 7 provides the lowest paper supply pressure, and the state of FIG. 1 provides the medium paper supply pressure between those provided by the states of FIGS. 6 and 7, respectively.

Figure 5:
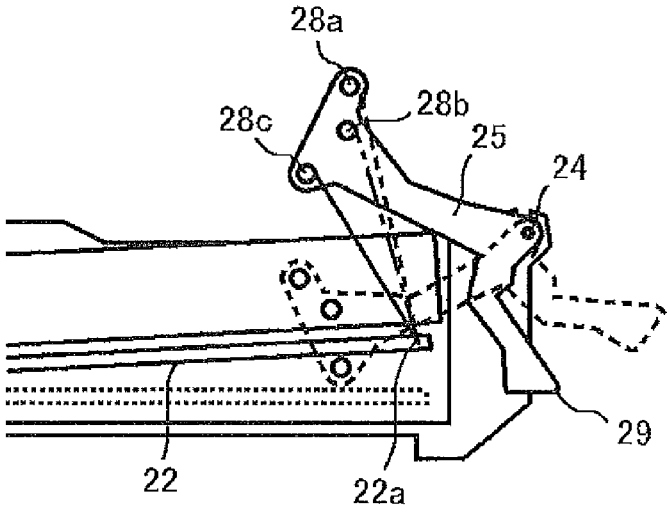
FIG. 5 illustrates a positional relationship of fastening pins.

Further, the three fastening pins 28*a*, 28*b* and 28*c* are arranged so that, when the hook 27*f* of the pressure spring 27 is hung on any one of the fastening pins 28*a*, 28*b* and 28*c*, the other two fastening pins do not obstruct movements of the pressure spring 27. Specifically, as shown in FIG. 5, the arrangement of the three fastening pins 28*a*, 28*b* and 28*c* is determined so that a straight line connecting the position of the fastening pin 22*a* of the bottom plate 22 and any one of the fastening pins 28*a*, 28*b* and 28*c* crosses none of the other two fastening pins.

Next, a task will be described of changing the fastening pin 28 from one to another of the three fastening pins 28*a*, 28*b* and 28*c* on which the hook 27*f* (having the semicircular shape) of the pressure spring 27 is hung, in order to change the paper supply pressure provided by the pressure spring 27.

The task of changing the fastening pin 28 on which the hook 27*f* of the pressure spring 27 is hung is carried out where the paper supply cassette 20 has been removed from the printer body 1. At this time, as shown in FIG. 2, the spring force of the pressure spring 27 becomes minimum since the distance between the fastening part 22*a* of the bottom plate 22 and the fastening pin 28 becomes shortest. Therefore, at this time, the operations of removing and then fitting the pressure spring 27 can be easily carried out. Further, the task of changing the fastening pin 28 on which the hook 27*f* of the pressure spring 27 is hung is carried out using a pointed tool such as a screwdriver, an eyeleteer or the like, for example. A person operates the tool from the top of the fastening pin 28, removes the hook 27*f* of the pressure spring 27 from one of the fastening pins 28*a*, 28*b* and 28*c* and hangs the hook 27*f* of the pressure spring 27 on another thereof. That is, for example, the operator operates a screwdriver, for example, from the top of the fastening pin 28, removes the hook 27*f* of the pressure spring 27 from the fastening pin 28, and again fits the hook 27*f* of the pressure spring 27 to the other desired fastening pin 28. Thus, the operator can carry out the task through the simple and easy operations. At this time, spaces 26*a* and 26*b* (as insertion spaces) (to which the extending end of the tool can be inserted) are provided in the arm member 25 at a side part of the T-part 26 shown in FIG. 3 and at a top part (as an extending end part) of the T-part 26 shown in FIG. 4, respectively, for the purpose of easily accessing the hook 27*f* of the pressure spring 27 with the tool from the top or from a direction oblique from upward, respectively.

Thus, in the paper supply part 10 according to the first embodiment of the present invention, it is possible to obtain the desired paper supply pressure by selecting the appropriate fastening position at which the pressure spring will be fastened. Further, the task of changing the paper supply pressure can be carried out through the simple and easy operations of changing the fastening position of the hook 27*f* of the pressure spring 27.

Figure 8:
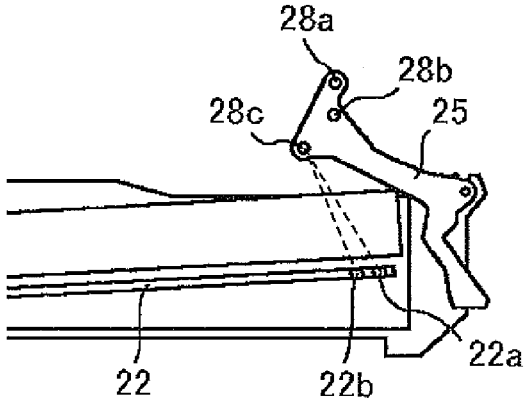
FIG. 8 illustrates a paper supply unit in a second embodiment of the present invention and FIG. 9 illustrates fastening parts shown in FIG. 8.

FIG. 8 illustrates a part of the paper supply cassette 20 in a second embodiment of the present invention. The paper supply cassette 20 and the image forming apparatus according to the second embodiment of the present invention are approximately the same as the paper supply cassette 20 and the image forming apparatus according to the first embodiment of the present invention described above with reference to FIGS. 1 through 7. Therefore, duplicate description will be omitted.

Figure 9:
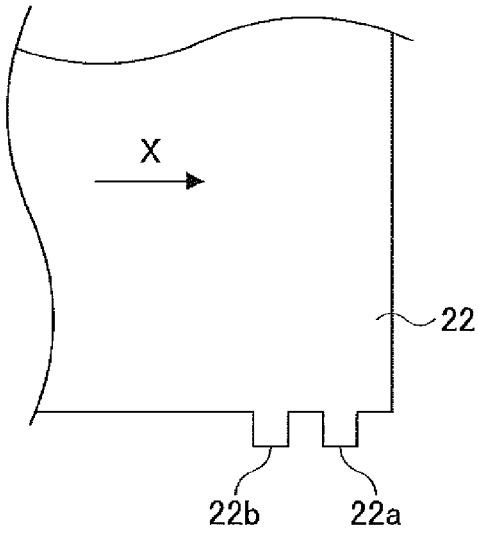

According to the second embodiment, in addition to the three fastening pins 28*a*, 28*b* and 28*c* of the arm member 25 of the first embodiment, two fastening positions are provided by respective two fastening parts 22*a* and 22*b* to the bottom plate 22. To any one of the two fastening parts 22*a* and 22*b* of the bottom plate 22, the hook 27*g* (see FIG. 2) of the pressure spring 27 is fastened. FIG. 9 illustrates the fastening parts 22*a* and 22*b* of the bottom plate 22 shown in FIG. 8. As shown in FIG. 9, the fastening parts 22*a* and 22*b* are formed at a part near the corner of the bottom plate 22, as respective projections that project in a direction perpendicular to the paper sending out direction X (and perpendicular to the plane of the page of FIG. 8). It is noted that FIG. 9 shows a partial plan view of the bottom plate 22.

Thus, the fastening positions (i.e., the fastening parts 22*a* and 22*b*) of the bottom plate 22 are formed to be disposed forward and backward in the paper sending out direction X. Thereby, it is possible to change the paper supply pressure by changing the fastening position between the fastening parts 22*a* and 22*b* to which the hook 27*g* of the pressure spring 27 is fastened. For example, as shown in FIG. 8, a case where the pressure spring 27 is fastened between the fastening pin 28*c* of the arm member 25 and the fastening part 22*a* of the bottom plate 22 is compared with a case where the pressure spring 27 is fastened between the fastening pin 28*c* of the arm member 25 and the fastening part 22*b* of the bottom plate 22. Then, it is seen that the case where the pressure spring 27 is fastened between the fastening pin 28*c* of the arm member 25 and the fastening part 22*a* of the bottom plate 22 provides the distance between the fastening pin 28*c* and the fastening part 22*a* which is longer than the distance between the fastening pin 28*c* and the fastening part 22*b* provided by the case where pressure spring 27 is fastened between the fastening pin 28*c* of the arm member 25 and the fastening part 22*b* of the bottom plate 22. Therefore, the case of using the fastening pin 28*c* and the fastening part 22*a* as the fastening positions for the pressure spring 27 provides the paper supply pressure higher than that provided by the case of using the fastening pin 28*c* and the fastening part 22*b* as the fastening positions for the pressure spring 27.

Therefore, according to the second embodiment, using combinations of the three fastening pins 28*a*, 28*b* and 28*c* of the arm member 25 and the two fastening positions 22*a* and 22*b* of the bottom plate 22, it is possible to not only more finely set the paper supply pressure, but also widen the available range of the paper supply pressure that will be set.

The present invention is not limited to the specifically disclosed embodiments, and variations and modifications may be made without departing from the scope of the present invention defined by the claims and any equivalents thereof.

For example, in the second embodiment described above using FIGS. 8 and 9, the number of the fastening pins 28 of the arm member 25 may be reduced to 1, but the pair of the two fastening positions 22*a* and 22*b* of the bottom plate 22 may be provided at each of plural separate positions for fastening the pressure spring 27.

The present patent application is based on Japanese Priority Patent Application No. 2011-052778, filed Mar. 10, 2011, the entire contents of which are hereby incorporated herein by reference.

What is claimed is:

1. A paper supply unit comprising:

a paper supply cassette configured to have a bottom plate for placing stacked recording media thereon, the bottom plate being able to be lifted at a downstream part in a recording medium sending out direction;

a sending out part configured to be disposed above and facing the downstream part of the bottom plate when the paper supply cassette is loaded at a paper supply position, wherein when the paper supply cassette is loaded at the paper supply position, the bottom plate is lifted so that the recording media come into contact with the sending out part;

a support member configured to be rotatably fitted at a side part of the paper supply cassette, said side part being disposed relatively downstream in the recording medium sending out direction; and an elastic member provided between the support member and the bottom plate to connect the support member and the bottom plate, wherein elastic force of the elastic member is used to lift the bottom plate, wherein the support member has plural fastening parts for fastening the elastic member, and the elastic force of the elastic member is changeable using the plural fastening parts, and the support member includes two plate members combined together with a certain distance therebetween, and the plural fastening parts are placed between the two plate members.

2. The paper supply unit as claimed in claim 1, wherein the elastic member is a helical tension spring, and respective hooks of the helical tension spring are hung on one of the fastening parts of the support member and a fastening part of the bottom plate.

3. The paper supply unit as claimed in claim 1, wherein the support member includes a support arm mounted on the paper supply cassette rotatably between a standby position and an elastic function position, and when the paper supply cassette is loaded at the paper supply position, the support arm is rotated from the standby position to the elastic function position at which the support member lifts the bottom plate via the elastic member.

4. The paper supply unit as claimed in claim 3, further comprising:

a curved plate configured to have a curved shape on which one end of the support member slides, wherein the support member is rotated as a result of the one end of the support member being pressed by the curved shape of the sliding plate while the one end of the support member is sliding on the curved shape of the curved plate so that the support member is rotated from the standby position to the elastic function position.

5. An image forming apparatus comprising:

an image forming part configured to form an image on a recording medium; and the paper supply unit, claimed in claim 1, configured to supply the recording medium to the image forming part.

6. The paper supply unit as claimed in claim 1, wherein the plural fastening parts have respective distances from a position at which the elastic member is fastened to the bottom plate, the distances being different from each other in a state of the paper supply cassette having been loaded at the paper supply position.

7. The paper supply unit as claimed in claim 1, wherein the bottom plate includes a fastening part, and when the paper supply cassette is loaded at the paper supply position, the respective positions of the plural fastening parts have different distances from the fastening part of the bottom plate.

8. A paper supply unit comprising:

a paper supply cassette configured to have a bottom plate for placing stacked recording media thereon, the bottom plate being able to be lifted at a downstream part in a recording medium sending out direction;

a sending out part configured to be disposed above and facing the downstream part of the bottom plate when the paper supply cassette is loaded at a paper supply position, wherein when the paper supply cassette is loaded at the paper supply position, the bottom plate is lifted so that the recording media come into contact with the sending out part;

a support member configured to be rotatably fitted at a downstream side part in the recording medium sending out direction of the paper supply cassette; and an elastic member provided between the support member and the bottom plate to connect the support member and the bottom plate, wherein elastic force of the elastic member is used to lift the bottom plate, wherein the support member has plural fastening parts for fastening the elastic member, and the elastic force of the elastic member is changeable using the plural fastening parts, wherein the support member includes two plate members combined together and disposed to provide a distance therebetween, and the plural fastening parts are provided between the two plate members, and at least one of a first insertion space, into which an extending end of a tool can be inserted to access the plural fastening parts through the first insertion space, at a side part of the support member and a second insertion space, into which the extending end of the tool can be inserted to access the plural fastening parts through the second insertion space, at an extending end part of the support member.

9. An image forming apparatus comprising:

an image forming part configured to form an image on a recording medium; and the paper supply unit, claimed in claim 8, configured to supply the recording medium to the image forming part.

* * * * *